US005718017A

United States Patent [19]

Pavlick

[11] Patent Number: 5,718,017

[45] Date of Patent: Feb. 17, 1998

[54] WASTE COLLECTOR

[76] Inventor: Curtis Pavlick, 1300 Aspenwood Dr., Seven Hills, Ohio 44131

[21] Appl. No.: 613,111

[22] Filed: Mar. 8, 1996

[51] Int. Cl.[6] ..... E01H 1/08

[52] U.S. Cl. ..... 15/340.1; 15/347; 406/41; 406/151

[58] Field of Search ..... 15/340.1, 340.2, 15/340.3, 340.4, 347; 55/356; 100/100; 406/39, 41, 151; 414/525.3

[56] References Cited

U.S. PATENT DOCUMENTS

| | | | |
|---|---|---|---|
| 2,663,894 | 12/1953 | Elliotte . | |
| 2,803,847 | 8/1957 | Hobbs . | |
| 3,087,187 | 4/1963 | Hank et al. . | |
| 3,412,532 | 11/1968 | Nickla . | |
| 3,556,327 | 1/1971 | Garrison . | |
| 3,613,915 | 10/1971 | Vita | 406/39 |
| 3,665,545 | 5/1972 | Beekman . | |
| 3,722,025 | 3/1973 | Gledhill | 15/340.1 |
| 3,847,293 | 11/1974 | Boon | 15/340.1 |
| 3,871,163 | 3/1975 | Kanengieter et al. . | |
| 3,995,754 | 12/1976 | DeKoning | 15/340.1 |
| 4,019,219 | 4/1977 | Willenborg . | |
| 4,344,272 | 8/1982 | Gaudette et al. . | |
| 4,443,997 | 4/1984 | Namdari . | |
| 5,030,259 | 7/1991 | Bryant et al. | 15/340.1 |
| 5,339,613 | 8/1994 | Wymore . | |
| 5,343,679 | 9/1994 | Cymara . | |

FOREIGN PATENT DOCUMENTS

| | | | |
|---|---|---|---|
| 3-192002 | 8/1991 | Japan | 414/525.3 |
| 5-254607 | 10/1993 | Japan | 406/39 |

*Primary Examiner*—Terrence Till
*Attorney, Agent, or Firm*—Vickers, Daniels & Young

[57] ABSTRACT

An apparatus for collecting both bagged and loose waste. The apparatus includes a hopper which is in flow communication with a waste receptacle for collecting bagged or bundled waste. The apparatus also includes a suction mechanism which draws loose waste into the waste receptacle. The hopper and the suction mechanism are arranged on the apparatus so that the hopper and/or suction mechanism can be used to collect waste without having to modify the suction mechanism and/or hopper.

45 Claims, 4 Drawing Sheets

WASTE COLLECTOR

The present invention relates to an apparatus for collecting waste, and more particularly, to an apparatus for removing debris from streets, curb sides, lawns, parks and other areas.

BACKGROUND OF THE INVENTION

Over the past several years, the disposal of waste has become a problem, especially for large metropolitan areas. Laws and regulations have been enacted which restrict the method in which municipalities dispose of waste. Due to environmental concerns with respect to the burning of waste such as grass, leaves and the like and the rapid rate at which municipal land fills are being filled, there has been a growing need for better methods of disposing of waste.

Many municipalities have addressed the environmental concerns with respect to grass, leaves, sticks, tree limbs and the like by prohibiting the burning of such waste and requiring the city residents to bag such waste or to pile such waste next to the curb for pickup and disposal by the municipality. Piled waste must be quickly picked up before such waste is washed into storm drains or the like during rain storms thereby causing blockage and flooding of such drains.

Many devices have been developed for picking up bagged waste. One such apparatus is a standard garbage truck which includes a waste receptacle wherein bagged waste is deposited into the receptacle. The garbage truck may also include a hopper positioned at the rear of the receptacle for collecting waste and a transport mechanism for moving the waste from the hopper into the receptacle. The transport mechanism may additionally compact the waste in the receptacle when the receptacle becomes full thereby increasing the storage capacity of the receptacle.

Although standard garbage trucks are adequate for bagged waste pickup, the capacity of such garbage trucks is severely compromised when picking up bagged leaves and other loosely packed garbage. Even garbage trucks, which use the transport mechanism as a compactor, can only compress the bagged leaves by no more than 2 to 3 fold. In addition, standard garbage trucks are not designed to pickup loose waste such as piled leaves, paper products discarded on the ground, or the like. Such loose waste requires the truck operator to manually pick up the loose waste and place such waste in the receptacle or hopper. This process is labor intensive, very time consuming and can interfere with proper waste disposal especially in a city operation which must collect a large amount of waste in a limited period of time.

Various devices have been designed to specifically deal with the picking up of loose waste. Such prior art devices are illustrated in U.S. Pat. Nos. 2,663,894; 2,803,847; 3,087,187; 3,665,545; 4,019,216 and 5,339,613. All of these devices incorporate a receptacle for storing the collected waste and a vacuum mechanism and/or sweeper mechanism for depositing the waste into the waste receptacle. Although these devices can pick up loose waste, these devices suffer from a number of deficiencies. Devices designed to use a vacuum to completely collect or substantially collect waste into the receptacle require complicated sealing arrangements and large, energy intensive vacuum mechanisms to adequately collect the waste. Such devices are very costly to operate and require constant maintenance to maintain the complex sealing arrangement of the vacuum. Devices which incorporate a mounted pickup nozzle or sweeper can only pick up waste as the device travels over the waste. Waste located on lawns, along the curbs, on sidewalks and in parks cannot be picked up by such device. Furthermore, these devices commonly mount the nozzle and/or sweeper in the front of the vehicle to make it easier for the operation to direct the nozzle or sweeper over the waste. However, such a mounting arrangement impairs the operator's vision when driving the device.

Standard garbage trucks have been retrofitted to convert the existing truck into a device for picking up loose waste. Such retrofitting includes sealing the hopper and attaching a vacuum unit to the sealed hopper. The modification of existing garbage trucks is advantageous in that money can be saved in not having to purchase and maintain another type of waste removal vehicle. However, the conversion of existing garbage trucks can be very difficult since the design of the hopper opening is different for different types of garbage trucks. In addition, the sealing of the hopper is extremely labor intensive and requires the garbage truck to be out of service for a substantial amount of time during conversion. Finally, a converted garbage truck can only pick up loose waste and must have the modification removed from the hopper before bagged waste can once again be picked up.

Although there are many devices for collecting bagged and loose waste, there does not exist a device for conveniently and effectively collecting bagged and loose waste without having to modify the device prior to picking up a certain type of waste. In view of the present state of the prior art, there is a demand for a device which can easily and cost effectively remove both loose and bagged waste and overcome the above stated problems which are associated with the disposal of such waste.

SUMMARY OF THE INVENTION

The present invention pertains to an apparatus for the collection of loose and bagged waste in a convenient and cost-effective manner. The apparatus is designed such that it can pick up and store such waste without having to modify the apparatus.

In accordance with the present invention, there is provided a vehicle which includes a waste receptacle for storing and transporting collected waste. Positioned adjacent to the waste receptacle there is provided an open ended hopper which is in flow communication with the receptacle. The hopper is designed to receive waste which is manually and/or automatically placed in the hopper. Such waste includes garbage bags, bundled matter, waste from garbage containers, small appliances, furniture and the like. Positioned between the receptacle and the hopper is a transport mechanism which moves the waste from the hopper and into the receptacle. The apparatus also includes a suction mechanism which is connected to the receptacle for collecting loose waste such as leaves. The suction mechanism is connected to the receptacle in a manner which does not to impair the loading and operation of the hopper. Such an arrangement provides for the collection of loose waste by a suction mechanism and collection of bagged waste in the hopper without having to place the apparatus out of service.

In accordance with another aspect of the present invention, the apparatus incorporates a compact mechanism for compacting waste in the receptacle. The compact mechanism is designed to increase the storage capacity of the receptacle. During the disposal of loose waste such as leaves, the capacity of the receptacle can be increased at least five fold, preferably at least ten fold and more preferably at least fifteen fold as compared to the air packing of leaves. The compacting of waste in the receptacle is also desirable since such compaction limits dust production during the removal of the waste from the receptacle. Waste such as leaves, grass clippings and the like can form dust clouds when depositing such waste from the receptacle into a land fill. The minimization of dust is desirable due to health concerns relating to allergies, skin irritation, etc. and various safety concerns such as the combustion of a dust cloud. The compacting of the waste significantly reduces the amount of dust formed during dumping. The compact mechanism is preferably positioned in the receptacle and includes a compact blade and a blade movement mechanism to cause the blade to move within the receptacle. A guide track may also be used to guide the compact blade within the receptacle. Preferably, the compact blade is positioned in the interior front end of the receptacle when not in use. When the operator activates the compact mechanism, the blade movement mechanism moves the blade toward the rear of the receptacle thereby causing the waste to be compressed between the transport mechanism and the compact blade. As can be appreciated, the transport mechanism can be designed to also compact waste in the receptacle separately and/or in conjunction with the compact mechanism.

In accordance with yet another aspect of the present invention, the apparatus incorporates one or more vents in the receptacle. The vents are designed to equalize the air pressure in the receptacle during the compaction of waste and/or the depositing of waste in the receptacle. During the compaction of waste, the air pressure between the compact blade and transport mechanism increases as the space between the blade and transport mechanism decreases. The increase in air pressure can interfere with the compaction of the waste. In addition, liquids such as water from wet leaves or grass can also interfere with the compaction of the collected waste. Preferably one or more vents are incorporated in the top of the receptacle to provide a passageway for the air during the compaction of the waste. The expulsion of water from the receptacle during the compaction of the waste can be accomplished by positioning one or more vents in the base of the receptacle. If base vents are used, the vents preferably include valves and/or doors to control flow of liquids from the receptacle. Pressure equalization in the receptacle is also important during the blowing of waste into the receptacle. Without proper venting, the blowing of the waste into the receptacle could over pressurize and damage the receptacle and/or impair the flow of waste into the receptacle. Preferably, one or more vents are provided in the top of the receptacle to substantially equalize the pressure between the inside and outside of the receptacle. The vents preferably include a filter mechanism to reduce the amount of dust and/or odors passing through the vents.

In accordance with another aspect of the present invention, the hopper and suction mechanism are in flow communication with the receptacle in different regions on the receptacle. Preferably, the hopper is connected to the rear of the receptacle and the suction mechanism is connected to the top of the receptacle and more preferably the top-front of the receptacle. By connecting the hopper and suction mechanism in such regions on the receptacle, the operation of the hopper does not impair the operation of the suction mechanism and vice versa. This arrangement allows an operator to collect loose waste with the suction mechanism and collect bagged waste into the hopper without having to perform any special modifications to the apparatus.

In accordance with still yet another aspect of the present invention, the suction mechanism includes an intake section, a vacuum-blower arrangement, and an output section. Preferably, the intake section includes a hose which can receive loose waste. The hose preferably includes a mouth-piece which can be mounted in a single position, or manually and/or automatically moved to a desired position. Preferably, the hose is made of a flexible, durable, relatively air tight material. The hose mouth-piece preferably includes a handle to help position of the mouth-piece. The mouth-piece may include a brush, rake or other type of sweep mechanism to assist in directing loose waste into the mouth-piece. A switch may be positioned on the handle to activate and/or deactivate the vacuum-blower arrangement and/or a device in the mouth-piece of the hose. A hose support such as boom can be used to assist in positioning the hose. The vacuum-blower arrangement includes a fan which is driven by a motor. The fan is designed to draw air into the hose mouth-piece and blow the drawn air out through the output section and into the waste receptacle. The speed of rotation and design of the blade is selected to cause sufficient air flow through the mouth-piece to draw wet/dry leaves and grass, sticks, paper and plastic products and like waste through the mouth-piece. The fan is preferably made of a durable material such as steel so as to resist being damaged as waste contacts the fan. The fan may also be designed to cut and/or shred waste as the waste passes through the fan. The cutting and shredding of the waste, such as sticks, facilitates in the blowing of such waste into the receptacle. The fan is preferably housed in a relatively air tight arrangement between the intake section and output section so a substantial portion of the air drawn into the intake section is blown into the output section. The output section preferably includes a blower extension such as a chute or tube which provides a passageway for the waste from the fan to the waste receptacle. The blower extension is preferably made of a durable, air tight material such as plastic, rubber and/or metal. The suction mechanism is designed to partially move waste in a vacuum to the fan and to blow the waste from the fan into the receptacle. It has been found that waste is easier to move if blown than moved solely in a vacuum. This is especially the case where the waste is to be transported to a higher elevation. In view of this phenomena, the fan is preferably positioned relatively near the ground. Furthermore, the maximum length of the intake section is selected to provide for adequate suction when the intake section is fully extended. Preferably, the length of the intake section is less than the length of the output section. This positioning of the fan and length selection of the intake allows for a smaller motor and/or fan to be selected which results in a savings with respect to power consumption. However, it can be appreciated that the suction mechanism can be designed to completely draw and/or substantially draw waste into the receptacle under a vacuum.

In accordance with another aspect of the present invention, at least part to the suction mechanism can be quickly disconnected from the truck body. Preferably, the vacuum-blower arrangement, intake section and a portion of the blower section are attached to a trailer. The trailer is preferably designed to be connected to the rear of the receptacle or rear of the hopper. Preferably, a latch mechanism is designed to easily connected and disconnected the trailer from the truck body. In addition, one or more of the components of the blower section are preferably designed to be easily connected and disconnected from one another. The disconnection of one or more components of the blower section plus the disconnection of the trailer from the truck body provides for the easy and quick removal of the suction mechanism from the truck body. The disconnecting of the suction mechanism is desirable prior to removing waste from the rear of the receptacle. As can be appreciated, the mounting of a majority of the suction mechanism components on a trailer provides for easier servicing and replacement of the suction mechanism.

In an alternative embodiment, a majority of the components of the suction mechanism are mounted on the receptacle such that the operation of the hopper and unloading of the receptacle can be accomplished without the removal or the re-arrangement of the suction mechanism. In this embodiment, the vacuum-blower mechanism and output section are preferably mounted on the top of the receptacle.

In accordance with another object of the present invention, the suction mechanism can be mounted to a variety of garbage trucks without substantial modification to the garbage trucks and without having to provide for a special design of the suction mechanism for each type of garbage truck. Preferably, the intake section and vacuum-blower mechanism are mounted onto a trailer that can be easily attached to a truck body. The output section preferably elevates to the top of the receptacle and is attached in a hole cut into the top of the receptacle. The mounting of the output section on the top of the receptacle can be easily accomplished for all types of garbage trucks. When the suction mechanism is not used, the hole for the output section can be easily covered with a door or cover.

In accordance with another aspect of the present invention, the hopper mechanism is pivotally mounted to the rear end of the receptacle between an opened and closed position. The open position of the hopper provides for waste to be removed from the receptacle at a dump site. The removal of the waste from the receptacle is preferably accomplished by moving the compactor blade from the front end of the receptacle to the rear end of the receptacle thereby forcing the waste out of the receptacle. Preferably, the hopper is connected at the top rear end of the receptacle and is opened and closed by a hydraulic and/or gear arrangement. A locking mechanism is preferably used to lock the hopper into the closed position to prevent the hopper from inadvertently opening.

It is an object of the present invention to provide a waste removal vehicle which can easily, efficiently and cost effectively pick up bagged and loose waste without having to substantially modify the vehicle.

It is another object of the present invention to provide a waste removal vehicle having a hopper designed to receive bagged waste and a suction mechanism designed to pick up loose waste.

It is still another object of the present invention to provide a waste removal vehicle wherein the operation of the suction mechanism and the operation of the hopper do not interfere with one another.

It is another object of the present invention to provide a waste removal vehicle with a compact mechanism for increasing the storage capacity of the waste receptacle.

It is still yet another object of the present invention to provide a waste removal vehicle which includes a venting mechanism for equalizing the pressure in the receptacle during the compacting and/or loading of waste in the receptacle.

It is yet still another object of the present invention to provide a waste removal vehicle wherein the suction mechanism can be easily connected and disconnected from the vehicle during operation and/or servicing of the suction mechanism and/or prior to removal of waste from the receptacle.

It is another object of the present invention to provide a waste removal vehicle which includes a suction mechanism that can easily be connected and be disconnected from a variety of garbage trucks.

It is still another object of the present invention to provide for a waste removal vehicle that can dispose of a variety of waste materials using low cost and low maintenance components.

These and other objects and advantages will become apparent to those skilled in the art upon reading and following the description taken together with the accompanying drawings.

BRIEF DESCRIPTION OF THE DRAWINGS

Reference may now be made to the drawings, which illustrate various embodiments that the invention may taken in physical form and in certain parts and arrangement of parts wherein.

PREFERRED EMBODIMENT OF THE INVENTION

Figure 1:
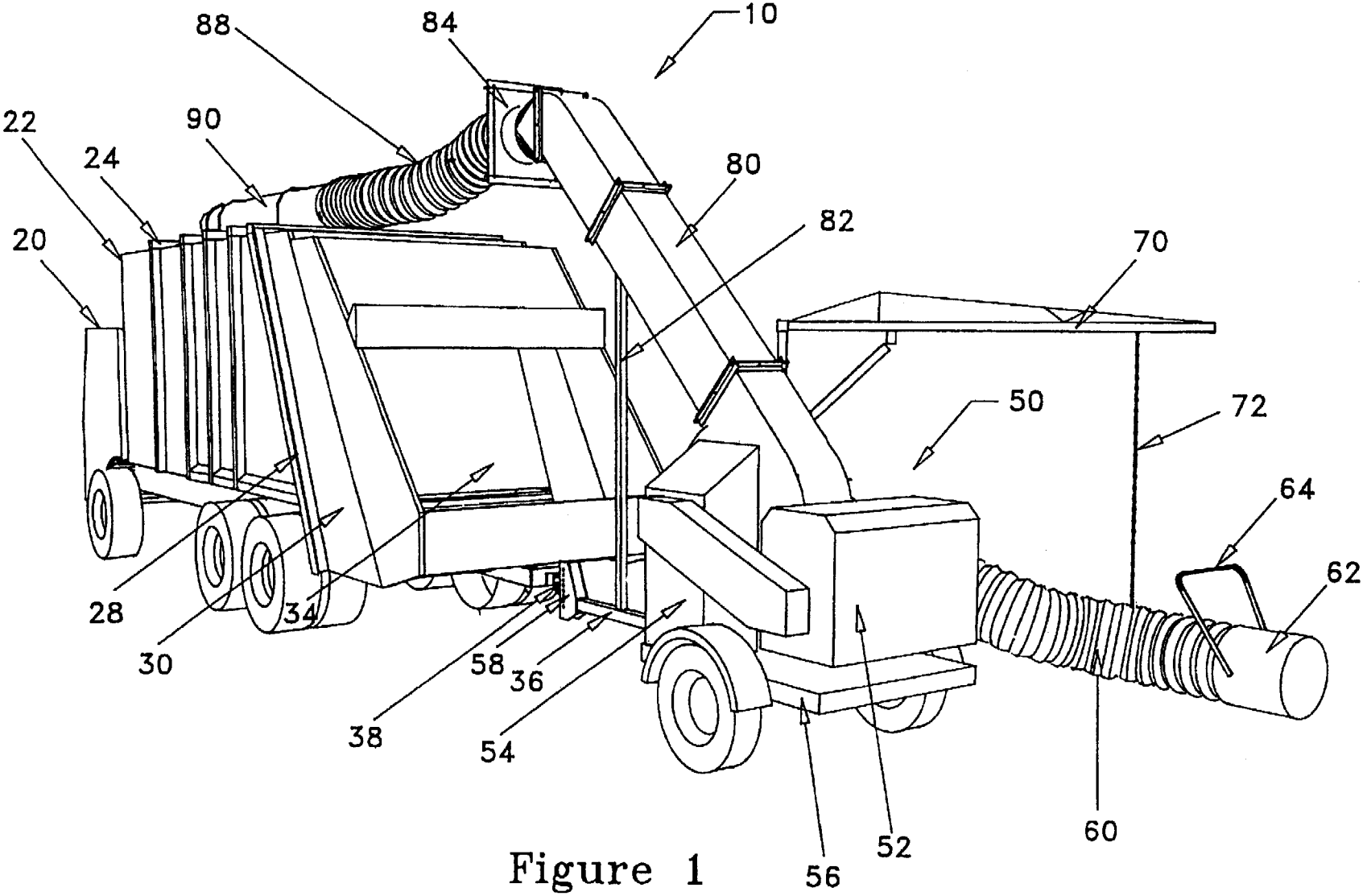
FIG. 1 is a plane view of the present invention illustrating the suction mechanism connected to the rear end of the hopper.
Figures 2, 4:
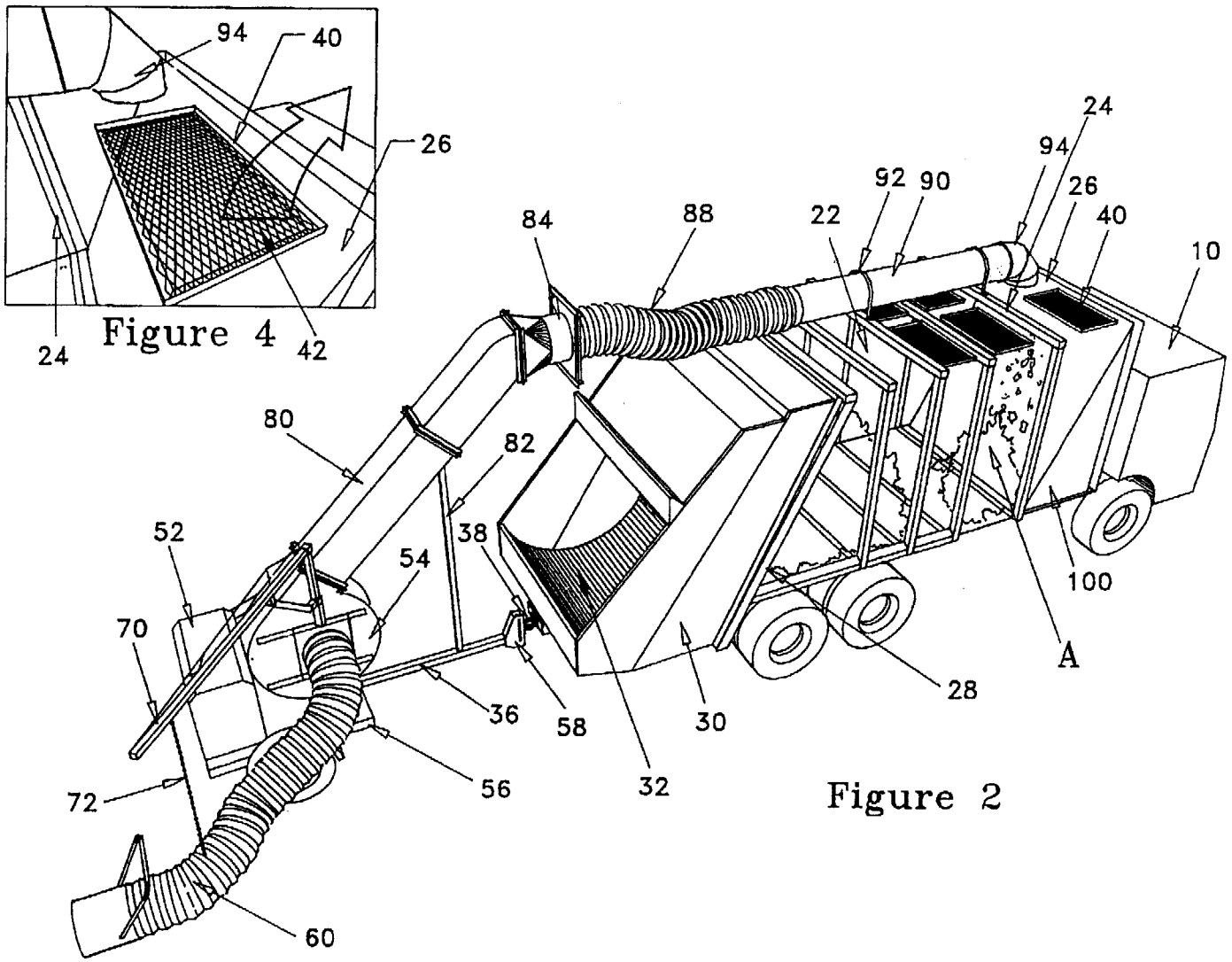
FIG. 2 is a sectional elevation view of the invention as disclosed in FIG. 1 illustrating the interior and top of the waste receptacle.
FIG. 4 is a partial view of the top of the waste receptacle illustrating a vent mechanism mounted in the waste receptacle; and, FIG. 5 is a plane view of the rear end of the invention illustrating waste being removed from the waste receptacle.

Referring now to the drawings, wherein the showings are for the purpose of illustrating the preferred embodiments of the invention only and not for the purpose of limiting the same, FIGS. 1 and 2 illustrate a waste removal vehicle 10 which includes a truck body 20 and a waste receptacle 22 mounted onto the frame of the truck body. The waste removal vehicle is an engine driven truck which is designed to be used on standard municipal streets for neighborhood and city pick up of waste. Waste receptacle 22 includes one or more reinforcement ribs 24 to reinforce the walls of the waste receptacle. Preferably, the waste receptacle is rectangular in design and includes several reinforcement ribs positioned about the exterior surface of the waste receptacle. The waste receptacle and reinforcement ribs are preferably made of metal to handle large loads and large internal pressures.

Connected to the rear end of the waste receptacle is hopper 30. Hopper 30 is connected to waste receptacle 22 at rear frame 28. Preferably, the hopper is pivotally mounted to the top rear end of frame 28 to allow the hopper to pivot between an opened and closed position. If the hopper is pivotally mounted, hopper 30 includes a locking mechanism to lock the hopper into the closed position. Hopper 30 includes a hopper bin 32 to hold waste placed into the hopper. Hopper packer 34 is connected to the rear of the hopper and is designed to move waste in hopper bin to the interior of waste receptacle 22. The hopper packer operates as a divider wall between the hopper and interior of the waste receptacle. The hopper packer preferably incorporates a standard sweep mechanism which includes a piston and cylinder mechanism for moving a sweeper. Such a design is well known in the art and will not be described further.

At the rear end base of hopper 30 there is provided a rear mount 38 connected to connection bar 36. Rear mount 38 is designed to be coupled with a trailer hitch 58 of trailer 56. The design of the trailer hitch and rear mount provide for quick and easy coupling and uncoupling of the trailer from the hopper.

Trailer 56 is designed to support the primary components of the suction mechanism which includes a vacuum-blower 50, an intake hose 60 and a blower extension 80. Vacuum-blower 50 includes a motor compartment 52 and a fan compartment 54. Within motor compartment 52 there is a provided a motor for driving a fan within fan compartment 54. Preferably, the motor is liquid or gasious fueled. The motor compartment and fan compartment are made of durable materials to protect the fan and motor from the elements.

Connected to fan compartment 54 is an intake hose 60. At the end of intake hose 60 there is provided an intake mouth piece 62 which includes an intake handle 64. Intake handle 64 is provided to allow the operator to position the mouth piece 62 during the pick up of loose refuse. Preferably, intake hose 60 is a flexible tube which allows for easy positioning of the intake hose and the mouth piece during the pick up of waste. The mouth piece 62 is preferably a circular housing made of a durable material such as a hard plastic or metal which resists being damaged during operation.

In an alternative embodiment of the present invention, a motorized brush or rake mechanism, not shown, is incorporated into the mouth piece to facilitate in the accumulation of refuse into the intake hose.

The suction mechanism is provided with a hose boom 70 having a chain 72 that is connected to the intake hose. The hose boom is designed to support and help move the intake hose. The hose boom is mounted to swing in a plane horizontal to the surface so that an operator can manipulate the position of the intake hose and mouth-piece.

In an alternative embodiment, the mouth-piece of the intake hose is mounted into a single position above the ground surface, not shown, for picking up waste as the mouth-piece is passed over the waste while the waste removal vehicle is moving.

The blower extension 80 is connected to fan compartment 54 and extends upwardly at an angle until it reaches a height of at least about the height of receptacle top 26. Blower extension 80 is supported in position by two extension supports 82 which are connected to trailer 56. The walls of blower extension 80 are preferably made of a durable material such as metal and are supported by at least one blower rib 81 positioned about the external surface of blower extension 80. The ribs help maintain he structural integrity of the blower extension during operation.

The top of blower extension 80 is provided with an extension coupler 84 designed to couple the blower extension with one end of blower hose 88. Extension coupler 84 is designed to easily and quickly connect and disconnect the blower hose and the blower extension. Blower hose 88 is a flexible and durable material similar to the material of intake hose 60. Blower hose 88 provides a flexible connection between the components of the suction mechanism on the trailer and components of the suction mechanism connected to the waste receptacle. The flexible connection allows the trailer to be freely drawn behind the truck body without concern for the tipping of the trailer or damage to one or more components of the suction mechanism. Connected to the other end of the blower hose is a blower tube 90. Blower tube 90 is a rigid tube mounted onto receptacle top 26 by one or more tube brackets 92. The connection between blower hose 88 and blower tube 90 also preferably includes a quick coupling mechanism to allow the blower hose to be quickly and easily connected and removed from the end of blower tube 90. At the end of blower tube 90, there is connected a receptacle connector 94 which provides a passageway between the interior of waste receptacle 22 and blower tube 90. Receptacle connector 94 is connected to a hole in the receptacle top which is preferably located near the top front end of the receptacle. The receptacle connector is preferably designed to be easily removed and attached to the receptacle top. When the receptacle connector is removed, a cover or door may be placed over the hole to seal the waste receptacle.

As can be appreciated, the connection of the suction mechanism to the rear of the truck eliminates any visual problems that would result if the suction mechanism was attached to the front of the truck. The trailer hitch and flexible blower hose allows the suction mechanism to be freely pulled by the truck. The connection of the suction mechanism to the truck is also arranged so as not to interfere with the operation of the hopper. The blower extension is designed to extend upwardly and above the hopper so as not to interfere with the loading of the hopper bin with bagged waste. Therefore, an operator can drive the waste removal vehicle to a waste site and load bagged waste and pick up any loose waste in a single trip.

During the operation of vacuum-blower 50, the motor causes the fan within fan compartment 54 to rotate thereby creating a vacuum within intake hose 60 which in turn draws waste into the mouth piece of the intake hose. The waste drawn into the intake hose is deposited into fan compartment 54. In the fan compartment, the waste contacts the rotating fan and is both thrown and blown into the blower extension. The contact of the waste with the fan may also result in the shredding and breaking up of the waste as it passes through the fan compartment. The fan is made of a durable material such as metal to resist damage during operation. Many types of waste may be drawn through the intake hose without damaging the suction mechanism. The waste propelled and blown into the blower extension is fluidized in an air stream thereby facilitating in the movement of the waste into the waste receptacle. The vacuum-blower is designed to create a sufficient vacuum in the intake hose to draw a wide variety of loose waste into the fan compartment. The vacuum-blower is also designed to create a sufficient thrust to propel the waste in the fan compartment at least 5–20 feet upwardly and at least 10–50 feet in a generally horizontal direction from the end of the blower extension to the waste receptacle. The components of the suction mechanism are preferably connected together to minimize air leaks which can interfere with the collecting and blowing of the waste.

Referring now to FIGS. 2 and 4, there is provided one or more vents 40 mounted in waste receptacle 22. Preferably, the vents are mounted in the top of the receptacle. Vents 40 include a vent grill 42 which prevents or inhibits objects from being expelled out of the waste receptacle. The vent grill is preferably made of metal to resist deformation from waste contacting the vent grill. Vent grill 42 may also incorporate a filter to reduce the amount of dust and/or odors escaping the interior of the waste receptacle. Vents 40, not shown, may also be positioned in the bottom of the waste receptacle to allow liquids to be removed from the waste receptacle. The vents are designed to provide sufficient air flow into and out of the waste receptacle to substantially equalize the pressure in the receptacle during the compacting of waste and/or blowing of waste into the waste receptacle. Preferably, at least one vent is positioned adjacent to receptacle connector 94.

Figure 3:
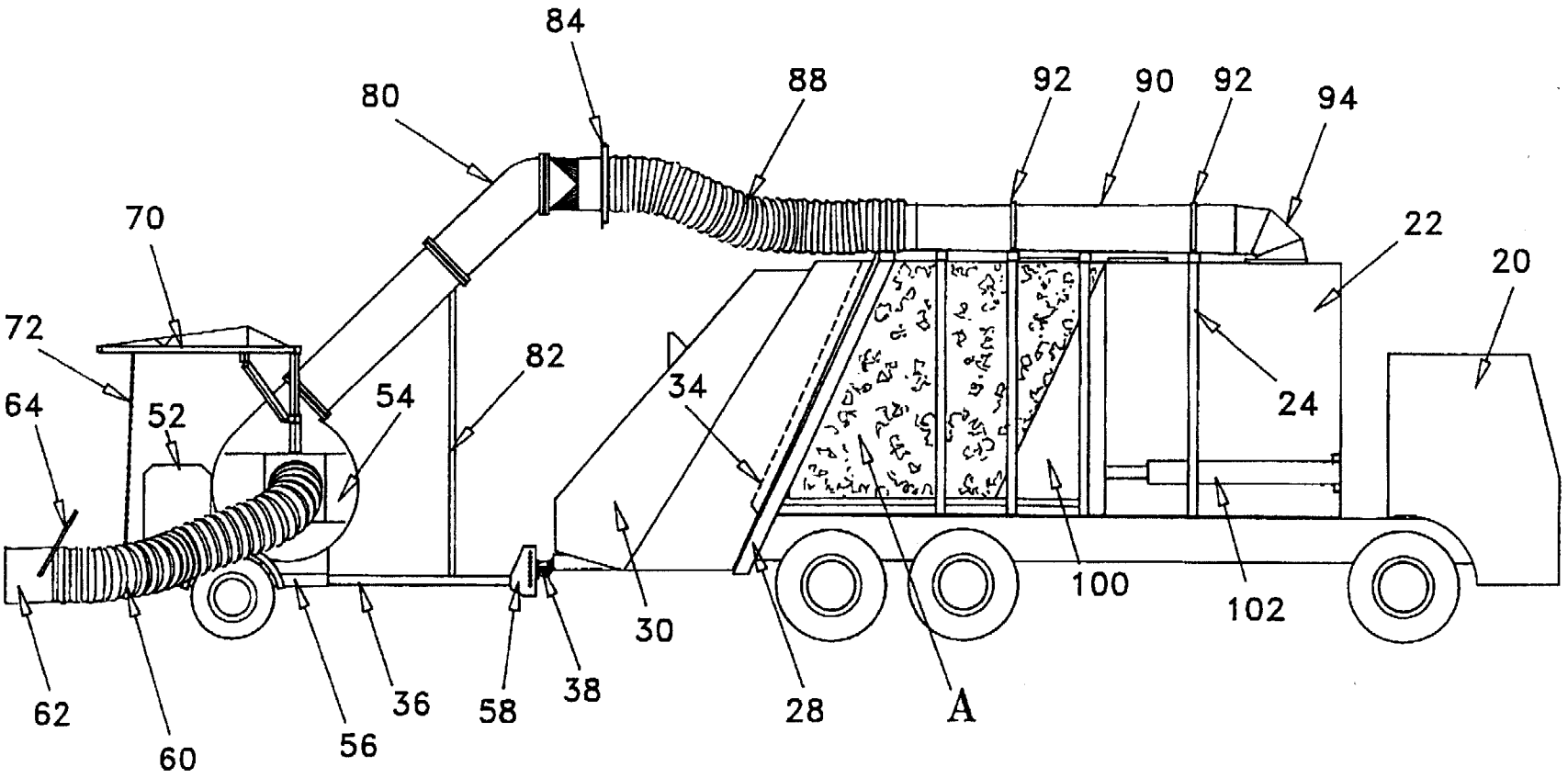
FIG. 3 is a side sectional view of the invention as disclosed in FIG. 1 illustrating the compacting of waste in the waste receptacle.

Referring now to FIGS. 2 and 3, a compact blade 100 is positioned in the interior of the waste receptacle. The compact blade preferably includes a sloped surface to facilitate in the compacting of waste within the waste receptacle, however, other designs may be used. The compact blade is moved between a stored position and a compact position by blade piston 102. In the stored position as illustrated in FIG. 2, the compact blade is positioned adjacent to the interior front wall of the waste receptacle. In this position, the compact blade does not interfere with waste being blown into the waste receptacle from receptacle connection 94 or sweeped into the waste receptacle from the hopper by hopper packer 34. Periodically during the collection of waste, the operator can compact the waste in the waste receptacle by activating blade piston 102 which causes the compact blade to move from the stored position to a compact position as illustrated in FIG. 3. As the compact blade is moved toward the rear end of the waste receptacle, waste A is compressed between the compact blade 100 and the wall of the hopper packer 34. A piston sensor may be used to sense the pressure being applied to the compact blade and to terminate the compaction operation upon reaching a preset pressure threshold. After the waste has been compacted, the compact blade is moved by the blade piston to the stored position. The use of compact blade during the collection of leaves increases the volume of leaves collected by at least 5–15 fold as compared to air packing. Blade piston 102 is preferably operated by a mechanical and/or hydraulic mechanism.

Figure 5:
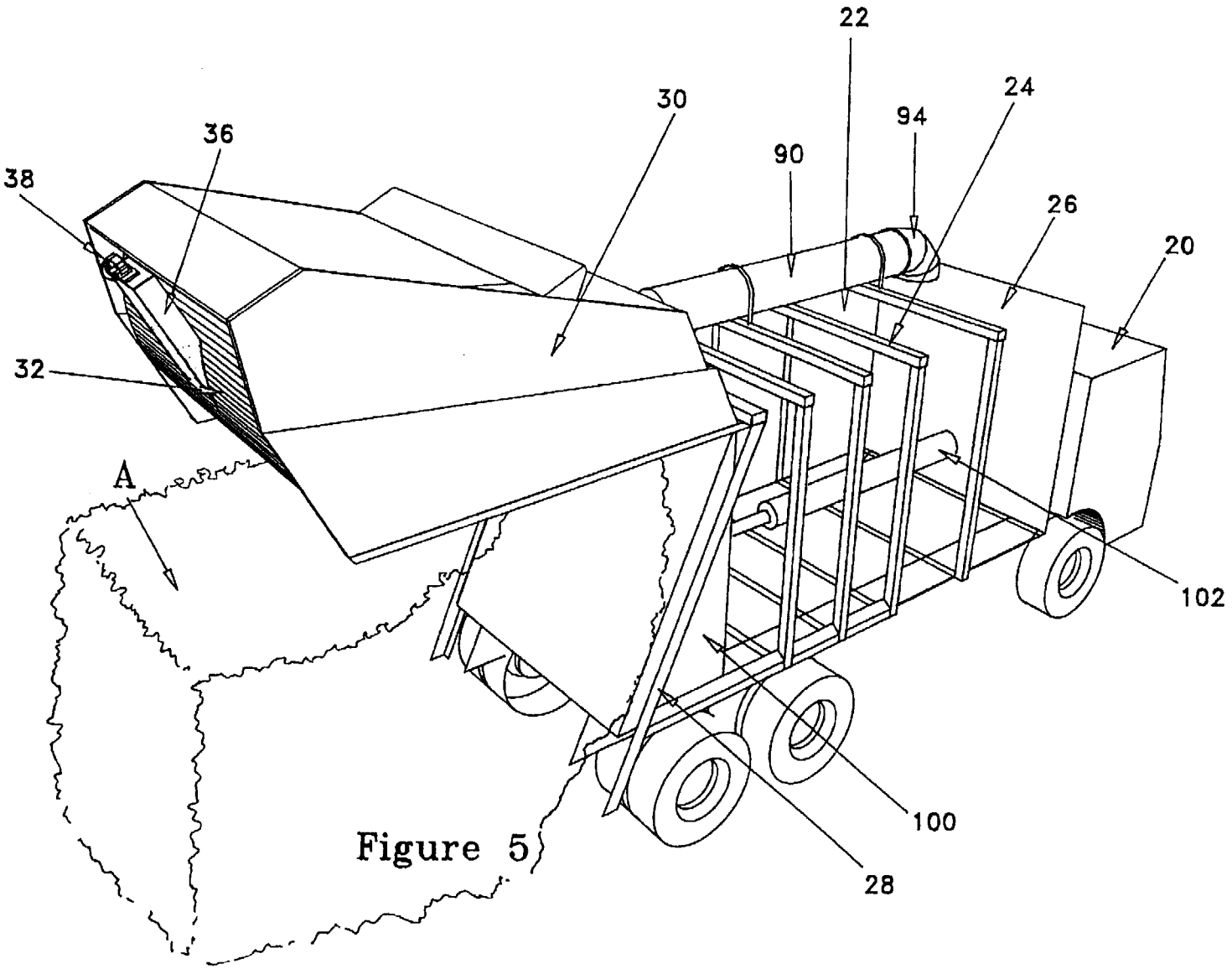

Referring now to FIG. 5, there is shown the expulsion of waste A from the waste receptacle. When waste A is to be removed from the waste receptacle, trailer 56, if being used, is disconnected from rear mount 38 on hopper 30 and blower hose 88 is disconnected from extension coupler 84 and/or the end of blower tube 90. Once the trailer and blower tube have been disconnected, hopper 30 is moved into its open position. Once hopper 30 is secured into the open position, blade piston 102 is activated to move compact blade 100 from the front end to the rear end of the waste receptacle thereby causing waste A to be expelled from the waste receptacle. As can be appreciated, the compact blade both compacts the waste in the waste receptacle and expels the waste from the receptacle thereby providing an efficient and self-cleaning waste system. Once the waste has been removed, compact blade 100 is repositioned to its stored position and hopper 30 is closed and locked in its closed position. Trailer 56 can once again be mounted to rear mount 38 and blower hose 88 is connected to extension coupler 88 and/or the end of blower tube 90.

The invention has been described with reference to a preferred embodiment and alternates thereof. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

I claim:

1. An apparatus for collecting waste comprising:

a) housing means for containment of said waste, said housing means includes a receptacle having a back end and a front end;

b) a hopper in flow communication with said housing means;

c) transport means for moving waste in said hopper into said housing means; and, d) suction means being connected to said housing means for collecting waste and directing said waste into said housing means, said hopper being connected to the back end of said receptacle, said suction means being connected to a top of said receptacle.

2. An apparatus as defined in claim 1, including compact means for compacting waste in said housing means.

3. An apparatus as defined in claim 1, wherein said hopper is connected to the back end of said receptacle.

4. An apparatus as defined in claim 1, wherein said suction means includes vacuum-blower means for creating a vacuum in at least part of said suction means.

5. An apparatus as defined in claim 4, wherein said vacuum-blower means includes means for blowing refuse into said housing means.

6. An apparatus as defined in claim 5, wherein said vacuum-blower means is positioned on a trailer.

7. An apparatus as defined in claim 6, wherein said trailer is connected to a rear of said hopper.

8. An apparatus as defined in claim 1, wherein said suction means includes vacuum-blower means for blowing refuse into said housing means.

9. An apparatus as defined in claim 1, wherein said compact means includes a compact blade and movement means for moving said blade, said movement means moving said blade between a stored position and a compact position.

10. An apparatus as defined in claim 9, wherein said stored position of said blade is closely adjacent to said front end of said housing means and said compact position of said blade in a position between said stored position and a rear end of said housing means.

11. An apparatus as defined in claim 1, wherein said hopper is pivotly attached to said housing means and is pivotable between an open and closed position, said open position providing a passageway to the interior of said housing means for allowing waste in said housing means to be removed from said housing means.

12. An apparatus as defined in claim 1, including equalization means positioned in said housing means for equalizing the air pressure in said housing means.

13. An apparatus as defined in claim 12, wherein said equalization means is positioned in the top of said housing means.

14. An apparatus as defined in claim 12, wherein said equalization means includes filter means for controlling the content of the air leaving said receptacle.

15. An apparatus as defined in claim 11, wherein said suction means includes a blower hose, a blower extension, vacuum-blower means and an intake hose, said blower hose at least partially flexible and having two ends wherein a first end mounted to said housing means and in communication with the interior of said housing means, said blower extension is a substantially rigid tube having two ends wherein a first end is connected to the second end of said blower hose and the second end is connected to said vacuum-blower means, said intake hose is at least partially flexible and having two ends wherein a first end is connected to said vacuum-blower means, and said vacuum-blower means for providing a vacuum in said intake hose to draw waste into said intake hose and for blowing waste into said second end of said blower extension tube.

16. An apparatus for collecting waste comprising:

a) a receptacle for containment of said waste, said receptacle having a back end, a front end;

b) a compaction mechanism which includes a structure that compresses said waste in said receptacle until said waste occupies a smaller volume in said receptacle;

c) a suction arrangement which collects and conveys said waste into said receptacle, said suction arrangement includes a, a vacuum-blower, a blower hose, a blower extension and an intake hose, said blower hose at least partially flexible and having two ends wherein a first end is mounted to said receptacle and in communication with the interior of said receptacle, said blower extension being a substantially rigid tube having two ends wherein a first end is connected to the second end of said blower hose and the second end is connect to said vacuum blower, said intake hose being at least partially flexible and having two ends wherein a first end is connected to said vacuum blower, and said vacuum blower providing a vacuum in said intake hose to at least partially assist in drawing waste into said intake hose and to at least partially assist in blowing waste into said second end of said blower extension tube; and, d) a vent positioned in said receptacle for equalizing the pressure in said receptacle.

17. An apparatus as defined in claim 16, wherein said compaction mechanism structure moves said waste between the front end and back end of said receptacle.

18. An apparatus as defined in claim 17, wherein said compaction mechanism structure moves said waste toward the back end of said receptacle during said compressing of said waste.

19. An apparatus as defined in claim 16, including a hopper connected to the rear of said receptacle and a transport arrangement which moves said waste in said hopper into said receptacle.

20. An apparatus as defined in claim 16, wherein said suction arrangement is attached to a top of said receptacle.

21. An apparatus as defined in claim 16, wherein said vent is positioned in a top of said receptacle.

22. An apparatus as defined in claim 16, wherein said suction arrangement includes quick coupling means for attaching and disconnecting said first end of said blower extension tube and said second end of said blower hose.

23. An apparatus as defined in claim 16, including a filter positioned in said vent to control the content of the air leaving said receptacle.

24. An apparatus for collecting waste comprising:

a) housing means for containment of said waste, said housing means includes a receptacle having a back end, a front end, and a top surface;

b) a hopper in flow communication with said housing means, said hopper pivotally is connected to the back end of said receptacle;

c) transport means for moving said waste in said hopper into housing means;

d) compact means for compacting said waste in said receptacle, said compact means includes a compact blade and movement means for moving said compact blade between a stored position and a compact position, said stored position being closely adjacent to said front end of said receptacle;

e) suction means connected to said top surface of said receptacle for collecting said waste and directing said waste into said receptacle, said suction means includes vacuum-blower means for at least partially assisting in collecting said waste and for at least partially assisting in directing said waste into said receptacle; and, f) vent means positioned in said housing means for equalizing the pressure in said receptacle.

25. An apparatus as defined in claim 24, wherein said vacuum means and said blower means are positioned on a trailer.

26. An apparatus as defined in claim 25, wherein said trailer is connected to the rear of said hopper.

27. An apparatus as defined in claim 24, wherein said vent means is positioned in the top of said receptacle.

28. An apparatus as defined in claim 24, wherein said vent means includes filter means for controlling the content of the air leaving said receptacle.

29. An apparatus as defined in claim 24, wherein said suction means includes a blower hose, a blower extension, vacuum-blower means and an intake hose, said blower hose at least partially flexible and having two ends wherein a first end mounted to said housing means and in communication with the interior of said receptacle, said blower extension is a substantially rigid tube having two ends wherein a first end is connected to the second end of said blower hose and the second end is connected to said vacuum-blower means, said intake hose is at least partially flexible and having two ends wherein a first end is connected to said vacuum-blower means, and said vacuum-blower means for providing a vacuum in said intake hose to draw waste into said intake hose and for blowing waste into said second end of said blower extension tube.

30. An apparatus as defined in claim 24, wherein said suction means including quick coupling means for attaching and disconnecting said first end of said blower extension tube and said second end of said blower hose.

31. An apparatus for collecting waste comprising:

(a) housing means for containment of said waste, said housing means includes a back end and a front end;

b) a hopper connected to the back end of said housing means, said hopper including an opening to receive said waste and a second opening providing flow communication with said housing means;

(c) transport means for moving waste in said hopper into said housing means;

(d) suction means being connected to said housing means for collecting waste and directing said waste into said housing means; and, (e) compact means for compacting waste in said housing means, said compact means including means for compressing said waste by moving said waste toward said back end of said housing means.

32. An apparatus as defined in claim 31, wherein said suction means includes vacuum-blower means for creating a vacuum in at least part of said suction means.

33. An apparatus as defined in claim 32, wherein said suction means includes vacuum-blower means for blowing refuse into said housing means.

34. An apparatus as defined in claim 33, wherein said vacuum-blower means is positioned on a trailer.

35. An apparatus as defined in claim 34, wherein said trailer is connected to a rear of said hopper.

36. An apparatus as defined in claim 32, wherein said compact means includes a compact blade and movement means for moving said blade, said movement means moving said blade between a stored position and a compact position.

37. An apparatus as defined in claim 36, wherein said stored position of said blade is closely adjacent to said front end of said housing means and said compact position of said blade in a position between said stored position and a rear end of said receptacle.

38. An apparatus as defined in claim 32, wherein said hopper is pivotally attached to said housing means and pivotable between an open and closed position, said open position providing a passageway to the interior of said housing means for allowing waste in said housing means to be removed from said housing means.

39. An apparatus as defined in claim 32, wherein said suction means is connected to the top of said housing means.

40. An apparatus as defined in claim 41, wherein said equalization means includes filter means for controlling the content of the air leaving said housing means.

41. An apparatus as defined in claim 32, including equalization means is positioned in said housing means for equalizing the air pressure in said housing means.

42. An apparatus as defined in claim 41, wherein said equalization means is positioned in the top of said housing means.

43. An apparatus as defined in claim 39, wherein said suction means includes a blower hose, a blower extension, vacuum-blower means and an intake hose, said blower hose at least partially flexible and having two ends wherein a first end mounted to said housing means and in communication with the interior of said housing means, said blower extension a substantially rigid tube having two ends wherein a first end is connected to the second end of said blower hose and the second end is connected to said vacuum-blower means, said intake hose at least partially flexible and having two ends wherein a first end is connected to said vacuum-blower means, and said vacuum-blower means for providing a vacuum in said intake hose to draw waste into said intake hose and for blowing waste into said second end of said blower extension tube.

44. An apparatus as defined in claim 43, wherein said suction means includes quick coupling means for attaching and disconnecting said first end of said blower extension tube and said second end of said blower hose.

45. An apparatus as defined in claim 31, wherein said suction means includes vacuum-blower means for blowing refuse into said housing means.

* * * * *